US005272040A

United States Patent [19]

Nakasawa et al.

[11] Patent Number: 5,272,040

[45] Date of Patent: Dec. 21, 1993

[54] TONER FOR DEVELOPING ELECTROSTATIC LATENT IMAGES

[75] Inventors: Shinobu Nakasawa, Toyohashi; Hiroshi Fukao, Toyokawa; Keiji Asakawa, Ibaragi; Toshikazu Muramatsu, Takarazuka; Ichiro Demizu, Toyonaka, all of Japan

[73] Assignee: Minolta Camera Kabushiki Kaisha, Osaka, Japan

[21] Appl. No.: 858,898

[22] Filed: Mar. 27, 1992

[30] Foreign Application Priority Data

Apr. 9, 1991 [JP] Japan ..... 3-076035
Apr. 23, 1991 [JP] Japan ..... 3-091906

[51] Int. Cl.[5] ..... G03G 9/097
[52] U.S. Cl. ..... 430/110; 430/111
[58] Field of Search ..... 430/110, 108, 106, 111

[56] References Cited

U.S. PATENT DOCUMENTS 3,819,367 6/1974 Chatterji et al. ..... 430/110
4,623,605 11/1986 Kato et al. ..... 430/45
4,626,487 12/1986 Mitsuhashi et al. ..... 430/106
5,106,715 4/1992 Matsumura et al. ..... 430/110
5,155,000 10/1992 Matsumura et al. ..... 430/110

FOREIGN PATENT DOCUMENTS 55-157755 12/1990 Japan .

*Primary Examiner*—John Goodrow
*Attorney, Agent, or Firm*—Burns, Doane, Swecker & Mathis

[57] ABSTRACT

The present invention relates to a toner for developing electrostatic latent images which has silica and titania or alumina on the toner surface at specified ratio or in specified states, so that environmental stability in chargeability and stable copy images with fine texture can be obtained.

16 Claims, 1 Drawing Sheet

TONER FOR DEVELOPING ELECTROSTATIC LATENT IMAGES

BACKGROUND OF THE INVENTION

The present invention relates to a toner for developing electrostatic latent images in electrophotography, electrostatic recording and electrostatic printing.

A toner used in electrophotography is added with a fluidizing agent such as silica, titania and alumina in order to improve toner fluidization, toner cleaning properties and the like. Silica is generally added because of easiest availability. When only silica, however, is added to a toner, there arise problems such as high charging level at initial stage, environmental instability and deterioration of fluidizing properties caused by toner burying. In order to prevent such problems, a fluidizing agent such as titania or alumina is further added in addition to silica.

When fluidizing agents are added in combination as above mentioned, high charge amount at initial stage caused by silica is restrained and toner can be charged speedily to an adequate charging level. Therefore, toner can be made excellent in image properties at initial stage. Titania or alumina, however, has essentially lower charging level than silica. When used for a long time, toner is influenced adversely by alumina or titania to bring about problems such as lack of charge amount and toner scattering, further accompanied by toner fogs. Further, as toner is consumed, the essential problem that toner comes to lack charge amount after used for a long time in spite of toner supply can not be solved.

On the other hand, multi-color copy images can be formed by laminating various color toners. Such a color toner is generally composed of resin of lower softening point than that of resin used for a conventional black toner. It is necessary to treat the surface of toner with a large amount of inorganic particles in order to achieve fine texture of solid copy images. Silica itself has high electrical resistance and large specific surface area. When only silica is added to a toner as inorganic fine particles, the silica gives the toner so high charging ability that density of copy images becomes low. In particular, this problem is remarkable under low humid conditions. When only titania is used as inorganic fine particles, there arise problems such as lack of toner charge amount, fogs on copy ground and toner scattering because titania has relatively large particle size and low electrical resistance. These problems are remarkable under high humid conditions.

SUMMARY OF THE INVENTION

The object of the present invention is to provide a toner for developing electrostatic latent images having excellent properties in accordance with its use.

Another object of the present invention is to provide a full-color toner excellent in fluidity, chargeability and environmental stability.

Another object of the present invention is to provide a full-color toner that can form copy images of high quality and excellent in density and texture without toner scattering and toner fogs.

Further object of the present invention is to provide a toner for developing electrostatic latent images which is excellent in chargeability both at initial stage and after used repeatedly for a long time and which can form copy images of high quality and excellent in density without toner fogs.

The present invention relates to a toner for developing electrostatic latent images which has silica and titania or alumina on the toner surface at specified ratio or in specified states.

DETAILED DESCRIPTION OF THE INVENTION

The present invention relates to a toner for developing electrostatic latent images which has silica and titania or alumina on its surface.

The present invention also relates to a full-color toner for developing electrostatic latent images comprising;

resin particles comprising a thermoplastic resin and a colorant selected from the group consisting of yellow colorants, magenta colorants, cyan colorants and black colorants, silica existing on the surface of resin particles in half-buried states and titania or alumina existing on the surface of resin particles in non-buried states.

The present invention further relates to a toner comprising;

a starting toner put into a developing machine in advance which is prepared by mixing resin particles containing a thermoplastic resin and a colorant, hydrophobic silica and hydrophobic titania or hydrophobic alumina, and a replenishing toner for making up for consumed toner which is prepared by mixing resin particles containing a thermoplastic resin and a colorant, hydrophobic silica and hydrophobic titania or hydrophobic alumina; the addition amount $T_A$ (% by weight) of hydrophobic titania or hydrophobic alumina in the starting toner and the addition amount $T_B$ (% by weight) thereof in the replenishing toner satisfying the relationship: $T_B > T_A$.

First, the explanation is given in the case that the present invention is applied to a full-color toner.

Full-color toners to which the present invention can be applied is not particularly limited. Conventional full-color toners may be used. The present invention is characterized in that hydrophobic silica is made to exist on the surface of full-color toner in half-buried states and titania or alumina prepared by liquid phase reaction and hydrophobicly treated is adhered to the surface of full-color toner in non-buried states. Thereby, environmental changes of toner chargeability becomes small and solid copy images of fine texture can be formed.

Silica used in the present invention have primary particle size of 5–20 mμm and is treated hydrophobicly, which is conventionally added to a toner. Such silica can be available as hydrophobic silica R-972 (primary particle size of 16 mμm; made by Nippon Aerosil K.K.), hydrophobic silica R-974 (primary particle size of 12 mμm; made by Nippon Aerosil K.K.), hydrophobic silica R-976 (primary particle size of 7 mμm; made by Nippon Aerosil K.K.) and hydrophobic silica H2000, H2000/4 (primary particle size of 10–15 mμm; made by Wacker K.K.).

Figure 1:
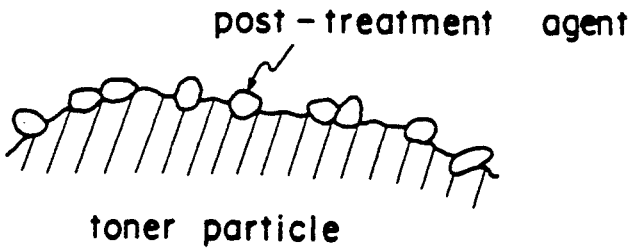
FIG. 1 shows that schematic view of toner surface with inorganic fine particles in half-buried states.
Figure 2:
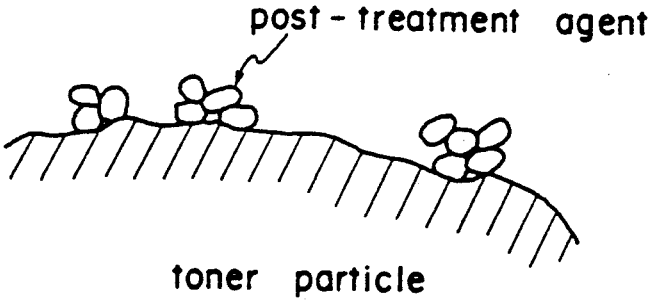
FIG. 2 shows that schematic view of toner surface with inorganic fine particles in adherence states.

In the present invention, silica particles are made to exist on the surface of toner particles in half-buried states. The half-buried states mean that particles are adhered and a part of particle is buried in the surface of toner as shown in FIG. 1. When particles are adhered but not buried in the surface as shown in FIG. 2, such states are referred to as non-buried sates. Because silica itself is very fine and high electrically resistant and a large amount of silica is added, the charge amount of toner is liable to increase, in particular, under low humid environments. But, silica is buried in the surface in half-buried states according to the present invention, the adverse influences of silica can be prevented while the number of charging points of silica particles are secured. Therefore, while the chargeability of toner is kept, the rise of charge amount can be restrained under low humid environments. When addition amount of silica is decreased in order to avoid the adverse influences, the number of charging points of silica decreases to result in low chargeability of toner and poor texture of copy images. In the present invention, silica is added at the content of 0.1-1.0% by weight, preferably 0.1-0.5% by weight on the basis of toner. If the content of silica is less than 0.1% by weight, the effects of addition of silica can not be obtained. If the content of silica is more than 1.0% by weight, high chargeability of silica and poor environmental resistance can not be improved.

Further, titania or alumina, each of which is prepared by a vapor phase reaction and subjected to hydrophobic treatment, is made to exist on toner surface in not-buried conditions in the present invention.

Titania or alumina used in the present invention has particle size of 10-60 mμm and added at a content of 0.2-3.0% by weight, preferably 0.2-2.0% by weight on the basis of toner. When the content is less than 0.2% by weight, addition effects can not obtained. If the content is more than 3.0% by weight, charging level becomes too low. Titania and alumina take a role of a spacer between toner particles because of its large particle size compared with that of silica. Silica can not take such a role. In particular, aggregation of toner can be prevented at the time when toner is transferred. Copy images of high texture can be formed. Therefore, when titania or alumina is used in half-buried conditions in a same manner as silica, the effect as a apacer is not given to result in that fine texture of copy images is lost.

It is preferable that a weight ratio of silica to titania and/or alumina is adjusted to the range between 1:7 and 1:1, preferably to 1:6 and 1:2.

As to titania or alumina, it is desirable to use the one prepared by liquid phase reaction. Titania or alumina prepared by liquid phase reaction has few irregularities on surface and is not porous and so little water adhere to toner. Accordingly, as electrical charges do not leak on the surface of toner, uniformity of charge amount is secured. The electrical charges do not decrease, and fogs and smokes of toner particles are not brought about even in high humid and high temperature conditions. It is also known that titania or alumina can be prepared by vapor phase reaction. Such alumina or titania, however, is porous and has many irregularities, it is liable to be influenced by water compared with titania or alumina prepared by liquid phase reaction.

Fine particles of silica, titania and alumina added to toner are subjected to hydrophobic treatment from the view point of environmental stability.

As to an agent for hydrophobic treatment, various kinds of coupling agents such as silanes, titanates, aluminates and zircoaluminates and silicon oils are used. The silanes are exemplified by chlorosilanes, alkylsilanes, alkoxy silanes and silazanes.

A treatment of surface of inorganic fine particles such as titania and silica with an agent for hydrophobic treatment may be carried out in ordinary conditions, for example, as shown below. First of all, a specified amount of a liquid of agent for hydrophobic treatment itself or a solution of agent for hydrophobic treatment diluted in a solvent such as tetrahydrofuran (THF), toluene, ethyl acetate, methyl ethyl ketone or acetone is dropped or sprayed while the inorganic fine particles are stirred forcedly by means of a blender to be mixed sufficiently. The obtained mixture are put on a bat and heated in an oven to be dried. The dried mixture are pulverized again sufficiently in a blender. In such a dry process, respective agents for hydrophobic treatment may be used at the same time. The inorganic fine particles may be treated in a wet process in which the fine organic particles are dipped in a solution containing an agent for hydrophobic treatment dissolved in an organic solvent followed by drying and pulverizing.

It is desirable that the inorganic fine particles are heated at 100° C. or more before the hydrophobic treatment.

Silica, titania and alumina can be adhered to surfaces of toner particles in half-buried states or in not-buried states by adjusting mixing conditions. In general, a full-color toner is composed of resin of low viscosity to secure color-reproducibility, so the degree of half-buried states depends much on the mixing conditions.

The half-buried conditions can be achieved in severe conditions, for example, at higher stirring speed or for longer stirring time. In such severe conditions that inorganic particles are buried in surfaces of toners, aggregations of fine particles of silica are broken and the particles are adhered to the surfaces in uniformly dispersed states as shown in FIG. 1.

Reversely, non-buried conditions can be achieved in mild stirring conditions. The milder the conditions are, the lower the degree of buried degree are. In such conditions, the aggregations of inorganic fine particles are not broken completely, so the particles are adhered to surfaces of toners in aggregated states as shown in FIG. 2.

A resin used in the present invention is not limited so far as the resin is light-transmittable and heat-resistant to some extent and fixability is secured as a full-color toner. Such a resin is exemplified by polystyrenes, styrene-acrylic resins, polyethylenes, epoxy resins and polyesters. In particular, polyesters are preferable and exemplified by the ones prepared by condensing polyols such as bisphenols, ethylene glycols, triethylene glycols, 1,2-propylene glycols and 1,4-butanediols with aliphatic dibasic acids such as maleic acid, malonic acid and succinic acid and itaconic acid, and aromatic dibasic acids such as phthalic acids and isophthalic acids. The polyesters may contain unsaturated polyesters modified by graft-polymerization with aromatic vinyl monomers. A ratio of polyester in such a modified polyester is 50% by weight or more, preferably 60-90% by weight.

Suitable polyesters forming a toner in the present invention have a number average molecular weight (Mn) of 2500-12000, degree of dispersion (Mw/Mn) of 2-6, glass transition point (Tg) of 50°-70° C. and melting point of 80°–120° C. If the polyesters do not have such properties as above mentioned, light-transmittance of toner becomes insufficient and fixability and heat resistance become low. Although polyester resins above mentioned are, in general, poor in environmental stability, they can be used well according to the present invention.

As to a colorant, yellow colorants are exemplified by C.I.Pigment Yellow 12 and C.I.Pigment Yellow 13, magenta (red) colorants are exemplified by C.I. Pigment Red 122 and C.I. Pigment Red 57:1, and cyan (blue) pigments are exemplified by C.I.Pigment blue 15. The other various kinds of pigments and dyes which have been used in light-transmittable toner may be used without limitation of the colorants as mentioned above.

Then, the present invention is further explained in the case that toner is made excellent in durability with respect to copy.

A starting toner used in the present invention is added with hydrophobic silica of 0.1–1.0% by weight, preferably 0.2–0.5% by weight on the basis of untreated toner. Hydrophobic titania or hydrophobic alumina is added at a content of 0.2–3.0% by weight, preferably 0.2–2.0% by weight on the basis of untreated toner. A specified amount of titania or alumina is added as well as silica, high initial charging properties of silica itself are restrained and toner is charged speedily to adequate charging level as properties such as toner fluidity and texture of copy images are maintained. Copy images having sufficient density of copy images and excellent in image quality can be formed. If the addition amount of silica and titania is without the range above mentioned, toner fluidity is deteriorated to bring about problems in texture of copy images, fogs and the like.

A replenishing toner used in the present invention is added with hydrophobic silica at the same content as that of the starting toner. Hydrophobic titania or hydrophobic alumina is added at less content than that of the starting toner. Concretely, when the addition amount of hydrophobic titania or hydrophobic alumina into starting toner is referred to as $T_A$ % by weight and the addition amount of hydrophobic titania or hydrophobic alumina into replenishing toner is referred to as $T_B$ % by weight, the difference between $T_A$ and $T_B$ is adjusted to 0.1–1.0% by weight, preferably to 0.1–0.9% by weight. Thus, lack of charge amount is solved, toner scattering and toner fogs are not brought about and copy images excellent in copy density and texture are formed stably. If the difference of $T_A$–$T_B$ is not within the range above mentioned, there arise problems such as toner scattering and fogs on copy images.

It is desirable that the weight ratio of hydrophobic silica to hydrophobic titania and/or hydrophobic alumina is adjusted to the range between 1:7 and 1:1, preferably to 1:6 and 1:2 in the starting toner and the replenishing toner.

A toner added with a post-treatment agent of the present invention is fine particles composed generally of a binder resin such as acrylic resins, polystyrene resins, polyester resins, styrene-acrylic copolymer resins or epoxy resins, and a colorant. The present invention may be applied to any toner such as the one for a two-component developer used with magnetic carrier particles, the non-magnetic one for a single component developer or the magnetic one for a single component developer.

Specific examples are shown below.

Production Example of Titania

Titania produced by a liquid-phase method and having primary particle size of 50 mμm (MT600B; made by Teika K.K.) of 100 parts by weight was spray-coated with a solution containing silicone oil of the following formula [i]:

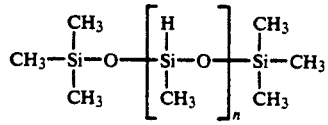

[i]

(n = 30~50)

of 5 parts by weight in xylene of 50 parts by weight. After dried, the obtained titania was treated by heat for one hour at 150° C. Thus, hydrophobic titania (A) was obtained.

Production Example of Resin for Full-color Toner

Polyoxyethylene(2)-2,2-bis(4-hydroxyphenyl)propane of 68 parts by weight, isophthalic acid of 16 parts by weight, terephthalic acid of 16 parts by weight, maleic anhydride of 0.3 parts by weight and dibutyltin oxide of 0.06 parts by weight were placed in a flask and treated under nitrogen atmosphere at 230° C. for 24 hours to give polyester resin containing unsaturated polyester. The obtained polyester resin had weight average molecular weight of 10,600.

The obtained polyester resin of 50 parts by weight were dissolved in xylene of 50 parts by weight in a flask. Temperature was raised until xylene was refluxed. A solution containing styrene of 13 parts by weight, methyl methacrylate of 2 parts by weight and azobisisobutyronitrile of 0.4 parts by weight was dropped into the flask in about 30 minutes under nitrogen atmosphere. After dropping, the solution temperature was kept for 3 hours. Xylene was removed by vacuum distillation to give styrene-acrylate modified polyester resin as a binder resin having weight average molecular weight of 13,100, melt viscosity of $6\times10^4$ (at 100° C.) poise and glass transition temperature of 63° C.

The melt viscosity was measured by using Flow Tester CFT-500 (made by Shimazu Seisakusyo K.K.) under conditions as nozzle diameter of 1 mm, nozzle length of 1 mm, loading weight of 30 kg and temperature rasing rate of 3° C. per minute.

PRODUCTION EXAMPLE (1) OF COLOR TONER (i) Yellow Toner

| | parts by weight |
|---|---|
| Styrene-acrylate modified polyester resin (obtained above) | 100 |
| Organic pigment Lionol Yellow FG-1310 (made by Toyo Ink Seizo K.K.) | 2.5 |
| charge controlling agent (Bontron E-84) (made by Oriento Kagaku K.K.) | 3 |

The above ingredients were mixed in a Henschell Mixer sufficiently, kneaded by means of a two axial extruder and cooled. The mixture was roughly broken by a feather mill, finely pulverized by a jet grinder and classified by air to give particles of 5-20 μm (mean particle size of 10.5 μm)

The obtained particles and hydrophobic silica H2000/4 (made by Wacker K.K.) of 0.3% by weight relative to the particles were treated in a Henschel mixer at 1,000 rpm for 3 minutes, followed by addition of titania (A) of 0.9% by weight. Thus, an yellow toner (1) was obtained.

The surface of the yellow toner (1) was observed by scanning electron microscope. Silica particles did not aggregate and exist uniformly in half-buried states on the surface of silica, while titania particles were not buried but adhered to the surface in aggregating states.

(ii) Magenta Toner

Magenta toner (1) was prepared in a manner similar to yellow toner (1) except that Lionol Red 6B FG-4213 (made by Toyo Ink Seizo K.K.) of 2.5 parts by weight was used as a pigment.

(iii) Cyan Toner

Cyan toner (1) was prepared in a manner similar to yellow toner (1) except that Lionol Blue FG-7350 (made by Toyo Ink Seizo K.K.) of 2.5 parts by weight was used as a pigment.

(iv) Black Toner

Black toner (1) was prepared in a manner similar to yellow toner (1) except that Lionol Yellow FG-1310 (made by Toyo Ink Seizo K.K.) of 2 parts by weight, Lionol Red 6B FG-4213 (made by Toyo Ink Seizo K.K.) of 5 parts by weight and Lionol Blue FG-7350 (made by Toyo Ink Seizo K.K.) of 5 parts by weight were used as a pigment.

Production Example (2) of Color Toner

Yellow toner (2), magenta toner (2), cyan toner (2) and black toner (2) were prepared in a manner similar to Production example (1) of color toner except that silica H2000/4 was treated at 1000 rpm for 1 minute and titania (A) was treated at 1000 rpm for 0.5 minute in Henschel mixer.

The obtained toners were observed by scanning electron microscope. Both silica and titania were adhered to surface of toners and not buried on the surfaces.

Production Example (3) of Color Toner

Yellow toner (3), magenta toner (3), cyan toner (3) and black toner (3) were prepared in a manner similar to Production example (1) of color toner except that both silica H2000/4 and titania (A) were treated at the same time at 1000 rpm for 4 minutes in Henschel mixer.

The obtained toners were observed by scanning electron microscope. Both silica and titania were adhered to surface of toners in half-buried states.

Production Example (4) of Color Toner

Yellow toner (4), magenta toner (4), cyan toner (4) and black toner (4) were prepared in a manner similar to Production example (1) of color toner except that the addition order of silica and titania was reverse to that of the Production example (1) and titania (A) was treated at 1000 rpm for 3 minutes and silica H2000/4 was treated at 1000 rpm for 0.5 minute in Henschel mixer.

The obtained toners were observed by scanning electron microscope. Silica was not buried in surfaces and titania existed on the surfaces in half-buried states.

Production Example of Carrier

Eighty parts by weight of styrene-acrylate copolymer composed of styrene, methyl methacrylate, 2-hydroxyethylacrylate and methacrylic acid (1.5:7:1.0:0.5) and 20 parts by weight of butylated melamine resin were dissolved with butyl to give a styrene-acrylic solution of 2% solids.

Baked ferrite particles (F-300; mean particle size: 50 μm, bulk density: 2.53 g/cm$^3$; made by Powdertech K.K.) were used as a core particle. The styrene-acrylic solution above obtained was applied to the ferrite particles by SPIRA COTA (made by Okada Seiko K.K.) and dried. The obtained carrier was baked in an oven under hot air-circulating conditions at 140° C. for 2 hours. After cooled, the ferrite particle bulk was broken and sifted by a screen classifier having screen meshes of 210 μm and 90 μm in screen opening. The above coating, baking and pulverizing processes were repeated three times more (referred to as first baking process).

The ferrite particles obtained in the first baking process were baked in the oven at 170° C. for 3 hours (referred to as second baking process). After cooled, the ferrite bulk was pulverized as above mentioned to give resin-coated carrier.

The resultant carrier had mean particle size of 52 μm, coating resin amount (Rc) of 2.95%, heat decomposition peak temperature of 295° C. and electrical resistance of about $4\times10^{10}$ Ωcm.

The coating resin amount (Rc) was measured as follows:

Resin-coated carrier of about 5 g was placed in magnetic crucible of 10 cc capacity which had been weighed precisely ($W_0$(g)) The total weight ($W_1$) was measured precisely. The crucible was placed in a muffle furnace. Temperature was raised at the rate of 15 degrees per minute to 900° C. The temperature 900° C. was kept for 3 hours to burn out the coating resin. After then, the crucible was left for cooling. As soon as the temperature fell to normal temperature, the crucible containing carrier was weighed precisely ($W_2$(g)). The coating resin amount was calculated as follows:

$$Rc(\%) = \frac{W_1 - W_2}{W_2 - W_0} \times 100$$

Particle size of carrier was measured by particle-size-distribution apparatus of laser-diffraction system (made by Microtrack K.K.).

Bulk density was measured according to JIS Z 2504 by use of specific-gravity-measuring apparatus (made by Kuramoti Kagaku Kikai Seisakusyo K.K.).

Heat decomposition peak temperature was estimated from DSC curve obtained by heat analytical apparatus (SSS-5000; made by Seiko Densi K.K.).

ESTIMATION

EXPERIMENTAL EXAMPLE 1

Each toner of yellow toner, magenta toner, cyan toner and black toner prepared in Production Example (1) of Color Toner was mixed respectively with the carrier prepared in Production Example of Carrier at the weight ratio of 8 (toner):92 (carrier) to obtain a developer.

The developer was evaluated by use of copying machine for full color (CF-70; made by Minolta Camera K.K.) on the following matters.

Charge Amount

Charge amount was measured by a blowing-off method (toner content of 8% by weight).

Fogs with respect to Copy.

Copy images were formed by use of the developers above obtained under conditions of normal temperature and normal humidity (25° C., 55%), low temperature and low humidity (10° C., 15%) and high temperature and high humidity (30° C., 85%). Fogs formed on white copy ground were evaluated to be ranked. When the rank is higher than "Δ", the toner ca be put into practical use. The preferable rank is "○".

Texture of Copy Images

Copy images were formed by use of each developer obtained above under the same conditions as above. The texture of copy images were evaluated on half tone images to be ranked. When the rank is higher than "Δ", the toner ca be put into practical use. The preferable rank is "○".

Image Density (I.D.)

Copy images were formed in the same manner as above to evaluate image density. The image density of solid copy images was measured by Sakura densitometer to be ranked. When the rank is higher than "Δ", the toner ca be put into practical use. The preferable rank is "○".

Environmental Change of Charge Amount (ΔQ)

The charge amount ($Q_{LL}$) measured after the developer was kept under environmental conditions of 10° C. and 15% for 24 hours and charge the charge amount ($Q_{HH}$) measured after the developer was kept under environmental conditions of 30° C. and 85% for 24 hours. The difference (ΔQ) between $Q_{LL}$ and $Q_{HH}$ was calculated from the equation below:

$$\Delta Q = Q_{LL} - Q_{HH} \ (\mu C/g)$$

The environmental change of charge amount was evaluated on the basis of ΔQ to be ranked.

The mark "X" means that charge amount varies largely depending on the environments and the developer can not be put into practical use. When the rank is higher than "Δ", the toner can be put into practical use. The preferable rank is "○".

EXPERIMENTAL EXAMPLE 2

Each toner of yellow toner, magenta toner, cyan toner and black toner prepared in Production Example (2) of Color Toner was mixed respectively with the carrier prepared in Production Example of Carrier at the weight ratio of 8 (toner):92 (carrier) to obtain a developer.

The developers were evaluated by use of copying machine for full color (CF-70; made by Minolta Camera K.K.) to evaluate the same matters as above described.

EXPERIMENTAL EXAMPLE 3

Each toner of yellow toner, magenta toner, cyan toner and black toner prepared in Production Example (3) of Color Toner was mixed respectively with the carrier prepared in Production Example of Carrier at the weight ratio of 8 (toner):92 (carrier) to obtain a developer.

The developers were evaluated by use of copying machine for full color (CF-70; made by Minolta Camera K.K.) to evaluate the same matters as above described.

EXPERIMENTAL EXAMPLE 4

Each toner of yellow toner, magenta toner, cyan toner and black toner prepared in Production Example (4) of Color Toner was mixed respectively with the carrier prepared in Production Example of Carrier at the weight ratio of 8 (toner):92 (carrier) to obtain a developer.

The developers were evaluated by use of copying machine for full color (CF-70; made by Minolta Camera K.K.) to evaluate the same matters as above described.

TABLE 1

| | | normal temp. normal humidity | | | low temp. low humidity | | | high temp. high humidity | | |
|---|---|---|---|---|---|---|---|---|---|---|
| | ΔQ | I.D. | BGD | TEX. | I.D. | BGD | TEX. | I.D. | BGD | TEX. |
| Exp. Exam. 1 | ○ | ○ | ○ | ○ | Δ~○ | ○ | ○ | ○ | ○ | Δ~○ |
| Exp. Exam. 2 | x | ○ | ○ | ○ | x | ○ | ○ | ○ | ○ | Δ~○ |
| Exp. Exam. 3 | ○ | ○ | ○ | x | Δ | ○ | x | ○ | ○ | x |
| Exp. Exam. 4 | x | ○ | ○ | Δ | x | ○ | Δ | ○ | ○ | x~Δ |

I.D.: Image density
BGD: Background
TEX.: Texture

Production Example of Untreated Toner (A)

| | parts by weight |
|---|---|
| Styrene-acrylate modified polyester resin (obtained in Production Example of resin) | 100 |
| Organic pigment Lionol Blue FG-7350 (made by Toyo Ink Seizo K.K.) | 3 |
| Charge controlling agent (Bontron E-84) (made by Oriento Kagaku K.K.) | 3 |

The above ingredients were mixed in a Henschell Mixer sufficiently, kneaded by means of a two axial extruder and cooled. The mixture was roughly broken by a feather mill, finely pulverized by a jet grinder and classified by air to give particles of 5–25 μm (mean particle size of 10.5 μm).

The particles thus obtained are referred to as "untreated toner (A)".

EXPERIMENTAL EXAMPLE 5

Starting Toner

Hydrophobic titania (T-805; made by Nippon Aerosil K.K.) of 1.65% by weight and hydrophobic silica (H2000/4;made by Wacker K.K.) of 0.3% by weight on the basis of the untreated toner (A) were mixed with the untreated toner (A) in a Henschel Mixer to give a starting toner.

Replenishing Toner

Hydrophobic titania (T-805; made by Nippon Aerosil K.K.) of 0.8% by weight and hydrophobic silica (H2000/4;made by Wacker K.K.) of 0.3% by weight on the basis of the untreated toner (A) were mixed with the untreated toner (A) in a Henschel Mixer to give a replenishing toner.

EXPERIMENTAL EXAMPLE 6

Starting Toner

Hydrophobic titania (T-805; made by Nippon Aerosil K.K.) of 0.95% by weight and hydrophobic silica (H2000/4;made by Wacker K.K.) of 0.3% by weight on the basis of the untreated toner (A) were mixed with the untreated toner (A) in a Henschel Mixer to give a starting toner.

Replenishing Toner

Hydrophobic titania (T-805; made by Nippon Aerosil K.K.) of 0.8% by weight and hydrophobic silica (H2000/4;made by Wacker K.K.) of 0.3% by weight on the basis of the untreated toner (A) were mixed with the untreated toner (A) in a Henschel Mixer to give a replenishing toner.

EXPERIMENTAL EXAMPLE 7

Starting Toner

Hydrophobic titania (T-805; made by Nippon Aerosil K.K.) of 1.1% by weight and hydrophobic silica (H2000/4;made by Wacker K.K.) of 0.3% by weight on the basis of the untreated toner (A) were mixed with the untreated toner (A) in a Henschel Mixer to give a starting toner.

Replenishing Toner

Hydrophobic titania (T-805; made by Nippon Aerosil K.K.) of 0.8% by weight and hydrophobic silica (H2000/4;made by Wacker K.K.) of 0.3% by weight on the basis of the untreated toner (A) were mixed with the untreated toner (A) in a Henschel Mixer to give a replenishing toner.

EXPERIMENTAL EXAMPLE 8

Starting Toner

Hydrophobic alumina (RX-C; made by Nippon Aerosil K.K.) of 1.1% by weight and hydrophobic silica (H2000/4;made by Wacker K.K.) of 0.3% by weight on the basis of the untreated toner (A) were mixed with the untreated toner (A) in a Henschel Mixer to give a starting toner.

Replenishing Toner

Hydrophobic alumina (RX-C; made by Nippon Aerosil K.K.) of 0.8% by weight and hydrophobic silica (H2000/4;made by Wacker K.K.) of 0.3% by weight on the basis of the untreated toner (A) were mixed with the untreated toner (A) in a Henschel Mixer to give a replenishing toner.

EXPERIMENTAL EXAMPLE 9

Starting Toner and Replenishing Toner

Hydrophobic titania (T-805; made by Nippon Aerosil K.K.) of 0.8% by weight and hydrophobic silica (H2000/4;made by Wacker K.K.) of 0.3% by weight on the basis of the untreated toner (A) were mixed with the untreated toner (A) in a Henschel Mixer to give a starting toner and a replenishing toner respectively.

EXPERIMENTAL EXAMPLE 10

Starting Toner

Hydrophobic titania (T-805; made by Nippon Aerosil K.K.) of 2.0% by weight and hydrophobic silica (H2000/4;made by Wacker K.K.) of 0.3% by weight on the basis of the untreated toner (A) were mixed with the untreated toner (A) in a Henschel Mixer to give a starting toner.

Replenishing Toner

Hydrophobic titania (T-805; made by Nippon Aerosil K.K.) of 0.8% by weight and hydrophobic silica (H2000/4;made by Wacker K.K.) of 0.3% by weight on the basis of the untreated toner (A) were mixed with the untreated toner (A) in a Henschel Mixer to give a replenishing toner.

EXPERIMENTAL EXAMPLE 11

Starting Toner

Hydrophobic titania (T-805; made by Nippon Aerosil K.K.) of 0.8% by weight and hydrophobic silica (H2000/4;made by Wacker K.K.) of 0.1% by weight on the basis of the untreated toner (A) were mixed with the untreated toner (A) in a Henschel Mixer to give a starting toner.

Replenishing Toner

Hydrophobic titania (T-805; made by Nippon Aerosil K.K.) of 0.8% by weight and hydrophobic silica (H2000/4;made by Wacker K.K.) of 0.3% by weight on the basis of the untreated toner (A) were mixed with the untreated toner (A) in a Henschel Mixer to give a replenishing toner.

The obtained toners obtained in EXPERIMENTAL EXAMPLES 5–11 were mixed respectively with the carrier at the content of 0.8% by weight to prepare a developer. The developer was put into a copying machine CF-70 (made by Minolta Camera K.K.). Copy images were formed such that toner consumption was about 200 mg per one copy. Copy images were evaluated on the following items below at the first stage and after copy was repeated 5000 times.

Charge Amount

Charge amount was measured by means of blow-off method (at the toner content of 0.8% by weight).

Density of Copy Images

Toner adhering amount of solid copy images per unit area was measured to be ranked as follows;

○: toner adhering amount is 0.9 mg/cm$^2$ or more.

x: toner adhering amount is less than 0.9 mg/cm$^2$.

Texture of Copy Images

Texture of copy of half images was evaluated to be ranked. The rank better than "Δ", the toner can be put into a practical use. Desirable rank is "○".

Fogs on Copy Images

Toner fogs on copy ground was evaluated visually to be ranked. The rank better than "Δ", the toner can be put into a practical use. Desirable rank is "○".

The results are summarized in Table 2.

TABLE 2

| | initial properties | | | | Copy Durability | | | |
|---|---|---|---|---|---|---|---|---|
| | Q/M | Image Dens. | Text. | fogs | Q/M | Image Dens. | Text. | fogs |
| Exp. Exam. 5 | −13.2 | ○ | ○ | ○ | −13.0 | ○ | ○ | ○ |
| Exp. Exam. 6 | −16.7 | ○ | ○ | ○ | −13.8 | ○ | ○ | ○ |
| Exp. Exam. 7 | −15.5 | ○ | ○ | ○ | −13.5 | ○ | ○ | ○ |

TABLE 2-continued

| | initial properties | | | | Copy Durability | | | |
|---|---|---|---|---|---|---|---|---|
| | Q/M | Image Dens. | Text. | fogs | Q/M | Image Dens. | Text. | fogs |
| Exp. Exam. 8 | −14.8 | ○ | ○ | ○ | −14.0 | ○ | ○ | ○ |
| Exp. Exam. 9 | −19.7 | x | ○ | ○ | −14.8 | ○ | ○ | ○ |
| Exp. Exam. 10 | −10.7 | ○ | ○ | x | −12.5 | ○ | ○ | ○ |
| Exp. Exam. 11 | −11.5 | ○ | Δ~x | x | −12.8 | ○ | ○ | ○ |

Q/M: μC/g, Image Dens.: Image Density, Text.: Texture

What is claimed is:

1. A full-color toner for developing electrostatic latent images comprising;

resin particles comprising a thermoplastic resin and a colorant selected from the group consisting of yellow colorants, magenta colorants, cyan colorants and black colorants, silica existing on the surface of resin particles in half-buried states and titania or alumina existing on the surface of resin particles in non-buried states.

2. A full-color toner of claim 1, in which the titania or the alumina is prepared by a liquid phase reaction.

3. A full-color toner of claim 2, in which the titania or alumina is hydrophobic.

4. A full-color toner of claim 1, in which the silica is hydrophobic.

5. A full-color toner of claim 1, in which the thermoplastic resin is a polyester resin having a number average molecular weight of 2500–12000, a ratio of weight average molecular weight to number average molecular weight (Mw/Mn) of 2–6, a glass transition point of 50°–70° C. and a softening point of 80°–120° C.

6. A full-color toner of claim 4, in which the hydrophobic silica is added at a content of 0.1–1.0% by weight on the basis of toner.

7. A full-color toner of claim 3, in which the hydrophobic titania or the hydrophobic alumina is added at a content of 0.2–3.0% by weight on the basis of toner.

8. A full-color toner for developing electrostatic latent images comprising;

resin particles comprising a thermoplastic resin and a colorant selected from the group consisting of yellow colorants, magenta colorants, cyan colorants and black colorants, silica existing on the surface of resin particles in the states of primary particles and titania or alumina existing on the surface of resin particles in aggregated-states of primary particles.

9. A full-color toner of claim 8, in which the silica has a primary particle size of 5–20 mμm.

10. A full-color toner of claim 8, in which the titania or the alumina has a primary particle size of 10–60 mμm.

11. A toner for developing electrostatic latent images comprising;

a starting toner put into a developing machine in advance which is prepared by mixing resin particles containing a thermoplastic resin and a colorant, hydrophobic silica and hydrophobic titania or hydrophobic alumina, and a replenishing toner for making up for consumed toner which is prepared by mixing resin particles containing a thermoplastic resin and a colorant, hydrophobic silica and hydrophobic titania or hydrophobic alumina; the addition amount $T_A$ (% by weight) of hydrophobic titania or hydrophobic alumina in the starting toner and the addition amount $T_B$ (% by weight) thereof in the replenishing toner satisfying the relationship: $T_B > T_A$.

12. A toner of claim 11, in which $T_A$ and $T_B$ satisfy the following relation below; $0.1 \leqq T_A - T_B \leqq 1.0$ 13. A toner of claim 11, in which the hydrophobic silica is added into the starting toner at a content of 0.1–1.0% by weight on the basis of untreated toner.

14. A toner of claim 11, in which the hydrophobic titania or the hydrophobic alumina is added into the starting toner at a content of 0.2–3.0% by weight on the basis of untreated toner.

15. A toner of claim 11, in which the hydrophobic silica is added into the replenishing toner at a content of 0.1–1.0% by weight on the basis of untreated toner.

16. A toner of claim 11, in which that a weight ratio of hydrophobic silica to hydrophobic titania or a weight ratio of hydrophobic silica to hydrophobic alumina is adjusted to the range between 1:7 and 1:1, in the starting toner and the replenishing toner.

* * * * *